United States Patent [19]

Sawyer

[11] 4,150,808

[45] Apr. 24, 1979

[54] CONCRETE CONSTRUCTION FORM PANEL

[76] Inventor: Robert D. Sawyer, 9550 S. 60th St., Milwaukee, Wis. 53132

[21] Appl. No.: 869,681

[22] Filed: Jan. 16, 1978

[51] Int. Cl.[2] ..... E04G 9/10

[52] U.S. Cl. ..... 249/111; 249/112; 249/189; 249/191

[58] Field of Search ..... 249/15, 16, 45, 112, 249/189, 191, 111; 52/404

[56] References Cited

U.S. PATENT DOCUMENTS

| | | | |
|---|---|---|---|
| 3,381,929 | 5/1968 | Bancker | 249/189 |
| 3,780,977 | 12/1973 | Dashew | 249/112 |
| 3,998,024 | 12/1976 | Frandsen | 52/404 |
| 4,027,846 | 6/1977 | Caplat | 249/189 |

*Primary Examiner*—Richard B. Lazarus
*Assistant Examiner*—John McQuade

[57] ABSTRACT

Removable form for use in pouring concrete walls, the form being comprised of a high strength, impact resistant, light weight material and being constructed to provide thermal insulation of concrete poured between two of the forms. The forms are each comprised of a face plate backed by an insulative support structure. The insulative support structure has a honeycomb construction filled with an insulative material, the honeycomb construction providing strength to the insulative support structure to prevent bending or distortion. A supporting frame is further provided as a structural supporting backing for the insulative support section to increase its resistance to bending.

9 Claims, 6 Drawing Figures

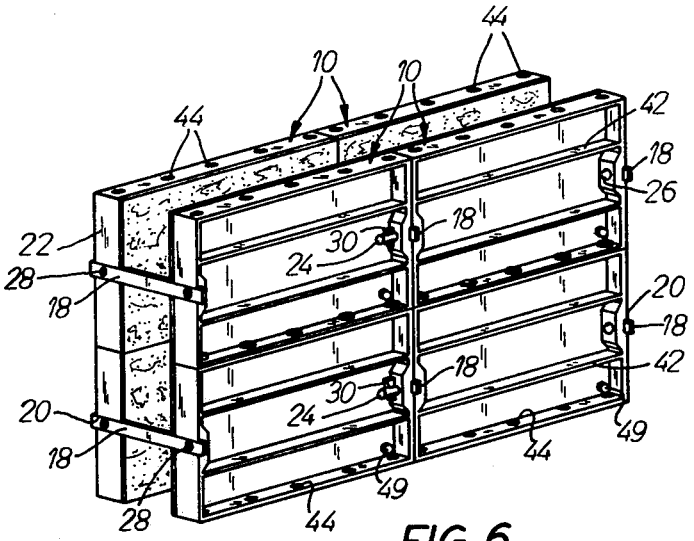
FIG. 6
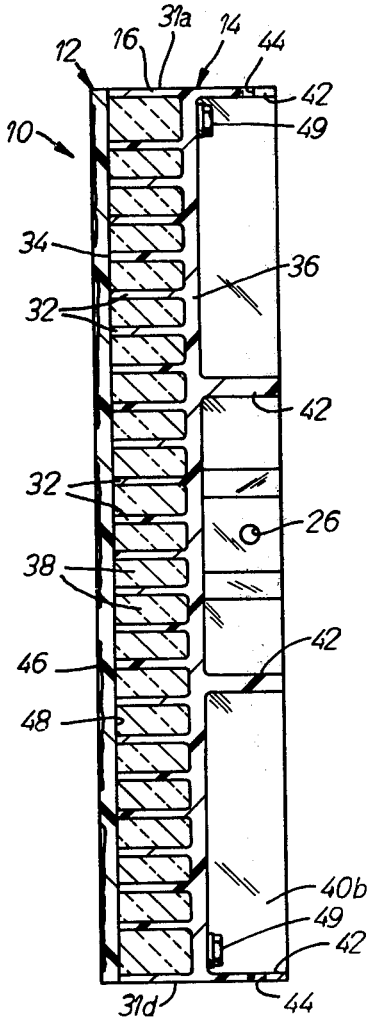
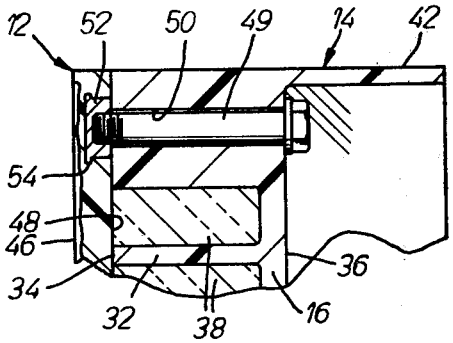
FIG. 5

CONCRETE CONSTRUCTION FORM PANEL

BACKGROUND OF THE INVENTION

1. Field of the Invention

The present invention relates to removable forms for use in pouring concrete walls, and more particularly to high strength forms resistant to bending and to forms which are light weight and which provide for thermal insulation of concrete poured between such forms.

2. Description of the Prior Art

Removable forms are frequently used to form poured concrete walls of basements or buildings. Such forms are frequently used repeatedly and must withstand substantial wear and abuse during handling and shipping. Concrete construction forms must also be very rigid to avoid bending when subjected to static pressure generated by the concrete when it is poured between the forms.

To accomodate the requirements that such forms be durable and resistant to bending, prior art forms have generally been constructed from steel, iron, wood or aluminum. Such forms have the disadvantage that they are relatively heavy and difficult to manipulate. Consequently, handling of the forms becomes time consuming and labor intensive, and concrete casting comprises a substantial part of the cost of building construction.

In colder climates, construction is frequently limited because cold ambient temperatures will result in premature curing of the poured concrete or freezing of the poured concrete before it has a chance to completely cure. To prolong the work season of concrete contactors and others involved in pouring concrete for construction purposes, there have been attempts to facilitate complete curing of the concrete by insulating the concrete after it is poured. During the curing process of concrete, hydrolysis results in chemical exothermic generation of heat. Accordingly, if the concrete can be sufficiently insulated against loss of heat, complete curing of the concrete can be achieved even at atmospheric temperatures well below 32° F.

Numerous prior art methods have been used to prevent heat loss from the concrete. For example, the poured concrete and forms are frequently covered with layered straw or sheet material such as large sheets of plastic. Some concrete forms have also been constructed to have insulation means integrally included. See, for example, U.S. Pat. No. 3,144,701, issued Aug. 18, 1964 to Bowden. The structure shown in the Bowden patent, however, does not provide sufficient insulation nor insulation evenly distributed across their surface area. Accordingly, such forms further require electrical heating devices. Such heating devices are cumbersome, require the availability of an electrical power supply and require the use of a substantial amount of electrical power during the curing cycle of the concrete.

SUMMARY OF THE INVENTION

The present invention provides an improved concrete wall form which has a combination of strength, minimum weight, durability and insulative character. The forms are also easily handled and reduce labor costs incident to concrete construction. Furthermore, the forms of the invention also facilitate curing of concrete even though the atmospheric temperature is less than 32° F., thereby increasing the working season for contractors and others in the construction industry.

The concrete forms of the present invention generally include a face plate providing a concrete forming surface. An insulative monolithic support structure is attached to the face plate to provide rigidity and to prevent heat loss. The concrete forms also include a supporting frame backing the insulative support structure and adding further rigidity to the insulative support structure and face plate. The monolithic insulative support structure is comprised of a thin rectangular box structure having an internal lattice network of partition walls defining a honeycomb configuration uniformly filled with an insulative material. The supporting frame consists of planar horizontal and vertical ribs joined to the rear surface of the insulative support structure. The ribs function to increase the strength of the forms and also to provide grips so that the forms can be easily handled.

In one preferred form of the invention the face plate, insulative support section, and supporting frame may be constructed from molded fiberglass or polymer material. Use of fiberglass, polymer material and also any other suitable light weight materials is facilitated by the unique structure of the form of the invention and has the advantage that the forms constructed in accordance with the invention can be lighter than prior art forms and thus more easily handled, yet they are sufficiently rigid to withstand pressures applied during concrete pouring. By reducing the weight of the concrete forms and facilitating handling, labor costs can be reduced significantly.

Another advantage of the concrete forms of the invention is that their construction includes a uniformly distributed thick layer of insulation therein. Accordingly, the forms are particularly effective to control heat loss from concrete during the curing process.

Another advantage of the concrete form of the invention is that the face plate can be removably attached to the insulative supporting section. Accordingly a face plate having a variety of decorative embossed concrete forming surfaces can be used with a single insulative supporting section. Thus, concrete contractors will not require a large inventory of forms in order to provide a variety of surface patterns.

Before describing the construction of the concrete forms of the invention in detail, it should be appreciated that the following description of the invention describes only one preferred embodiment of the invention and that other embodiments of the invention not inconsistent with the scope of the claims are within the scope of the invention.

BRIEF DESCRIPTION OF THE DRAWINGS

FIG. 4 is a cross-section side elevation view of the concrete wall form shown in FIG. 1;

FIG. 5 is an enlarged partial cross-section view similar to FIG. 4; and

FIG. 6 is a perspective view of a plurality of concrete wall forms in assembled relation and positioned to facilitate pouring of a concrete wall.

DESCRIPTION OF THE PREFERRED EMBODIMENT

Figure 1:
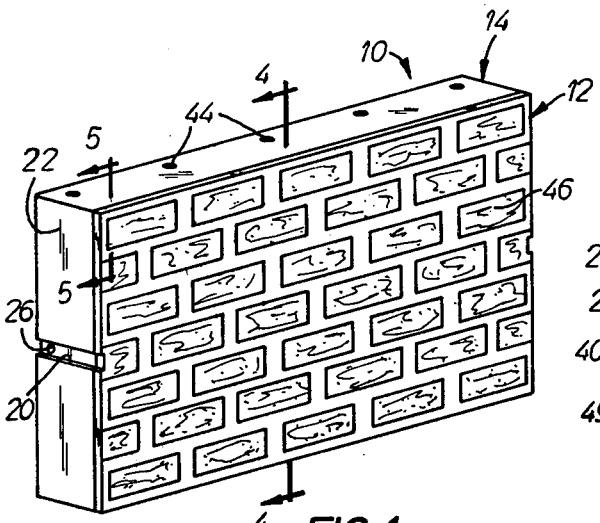
FIG. 1 is a perspective view of the concrete wall form of the present invention and showing the face plate of the concrete wall form.
Figure 2:
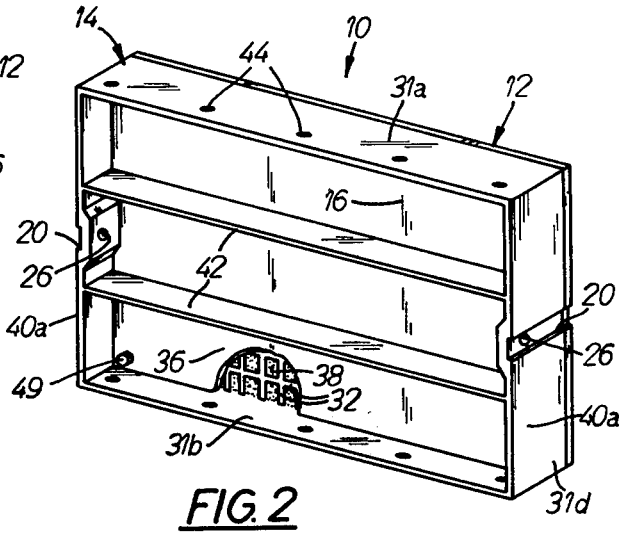
FIG. 2 is a perspective view of the concrete wall form shown in FIG. 1, but showing the back of the wall form.

A concrete wall form 10 of the invention is illustrated in FIGS. 1 and 2 and is generally comprised of a removeable face plate 12, a structural strengthening frame 14, and an insulative support section 16 between the removable face plate 12 and the strengthening frame 14, the insulative support section 16 being integrally joined to the strengthening frame 14. In a preferred embodiment of the invention, the face plate 12, strengthening frame 14 and insulative support section 16 are molded or otherwise constructed from high strength plastic, fiberglass, or like materials. Alternatively, these sections could also be constructed from cast or fabricated aluminum.

As shown in FIG. 6, a plurality of concrete wall forms 10 are intended to be rigidly joined together in coplanar relationship, the form assemblies being positioned in parallel spaced apart relationship to define a concrete pouring space therebetween. The concrete form assemblies are held in spaced apart parallel relationship by metal tie rods 18, the ends of the tie rods being received in grooves 20 in the vertical faces 22 of the forms 10 and secured by a pin 24 extending through a bore 26 in the vertical wall of the concrete form 10 and through an aligned bore 28 in the end of the tie rod 18. The pins 24 each include a longitudinal slot in their free end, the slot being intended to receive a wedge 30 when the pin is used to join two forms 10 together. The wedge 30 can be forced into the longitudinal slot in the pin 24 thereby forcing the two adjacent forms 10 into tightly abutting relationship.

Figure 3:
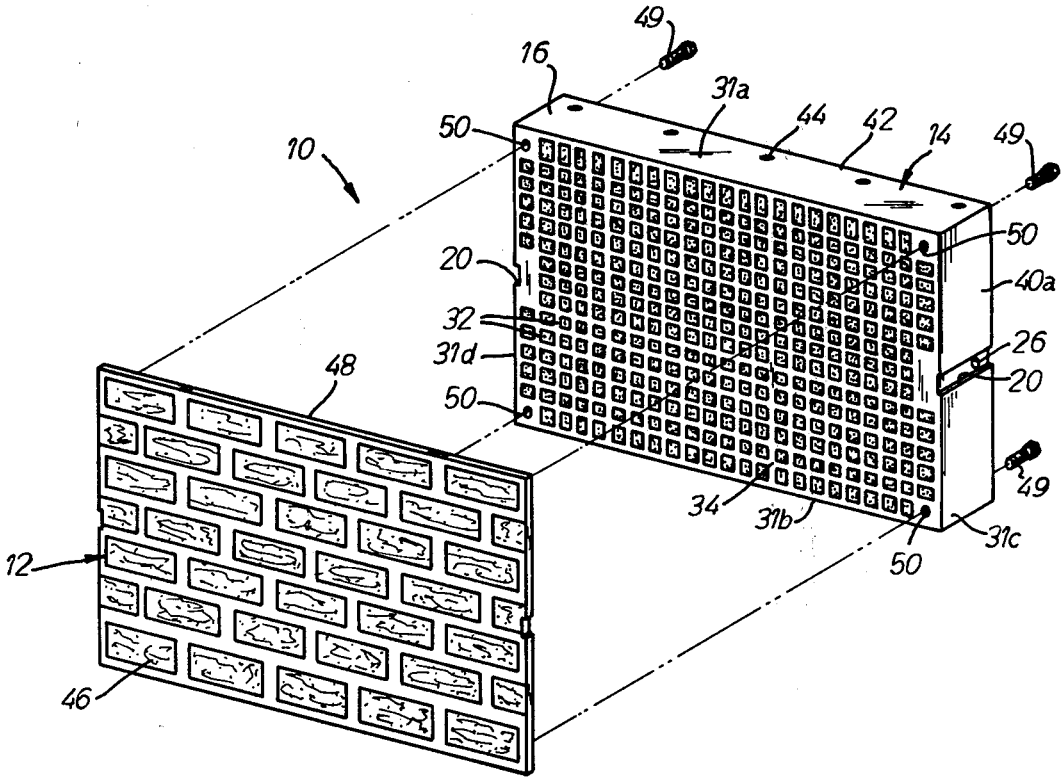
FIG. 3 is an exploded perspective view of the concrete wall form shown in FIG. 1.

The insulative support section 16 is best shown in FIGS. 3 and 4 and is generally comprised of a thin rectangular box structure including narrow elongated opposed parallel top and bottom walls **31*a* and 31*b* and vertical end walls 31*c* and 31*d* and further including an internal lattice network of integrally joined partition walls 32 defining a honeycomb structure. More particularly, the internal lattice network is comprised of generally perpendicular intersecting horizontal partition walls and vertical partition walls. It will be readily appreciated that lattice or honeycomb configurations other than those shown could be employed. The partition walls 32 are preferably perpendicular to the front face 34 of the insulative support section and a backing plate 36 of plastic material seals the rear face of the insulative support section 16, the backing plate 36 being integrally joined to the planar side walls of the planar box structure and the partition walls 32** defining the internal lattice network. At its front face, the honeycomb structure is open.

The honeycomb structure defined by the partition walls 32 is filled in the preferred form with a suitable thermally insulative plastic foam material 38 such as urethane foam, for example, or any other convenient thermally insulative light weight material.

As an alternative to the structure shown in FIG. 3, the front face of the insulative support structure 16 could also be sealed with an integrally attached or molded cover plate.

The strengthening frame section 14 is integrally attached to the backing plate 36 of the insulative section 16. Though the insulative section 16 is particularly constructed to be resistant to bending, the strengthening frame 14 is intended to provide additional support to the insulative section 16 to prevent pressure on the forms 10, caused by wet concrete poured into the assembled forms, from causing bending or distortion of the forms and consequent distortion of a poured concrete wall. The strengthening frame section 14 is comprised of a pair of planar vertical ribs **40*a* and 40*b* coplanar and integral with the vertical end walls 31*c* and 31*d*, respectively, and extending rearwardly from the backing sheet 36 of the insulative support section 16. The strengthening frame section 14 further includes four parallel planar horizontal ribs 42 extending between and integrally joined to the planar vertical ribs 40*a* and 40*b* and extending rearwardly from the backing sheet 36 of the insulative support section 16. One of the horizontal ribs 42 is coplanar with and extends rearwardly from the top wall 31*a* of the insulative support section 16 and another of the horizontal braces is coplanar with and extends rearwardly from the bottom wall 31*b* of the insulative support section 16. The other two horizontal ribs 42 are parallel and positioned generally equidistant the upper and lower horizontal ribs 42. The horizontal and vertical ribs 40*a*, 40*b* and 42, comprising the strengthening frame structure, resistance of the form 10** to bending and they also facilitate handling of the forms since the ribs are readily gripped.

Referring to FIGS. 2 and 6, the upper and lower horizontal planar ribs 42 of the strengthening frame section 14 each include a plurality of holes 44 therethrough intended to be aligned with complimentary holes 44 of an adjacent form 10 so that the forms can be bolted or pinned together in stacked relationship as shown in FIG. 6.

The face plate 12 of the concrete wall form 10 is best illustrated in FIG. 1 and 3–5. In the preferred embodiment, the face plate 12 comprises a rigid, thin generally planar sheet of molded plastic material shown in FIG. 3 as being removeably attached to the front face of the insulative support section 16. As an alternative, the face plate 12 could also be comprised of aluminum or other metal. The front surface 46 of the face plate 12 is contoured to provide a desired decorative configuration to the surface of the poured wall. The rearward surface 48 of the face plate 12 is smooth and planar and is intended to be position against the walls **31*a*–31*d* and partition walls 32 of the insulative supporting section 16**.

The face plate 12 is removably secured to the insulative support section 16 by four bolts 49 extending through bores 50 located in the respective corners of the insulative support section 16 and received in nuts 52 (FIG. 5) imbedded in the rearward surface 48 of the face plate 12. The nuts 52 include a peripheral flange 54 permitting them to be rigidly secured in place in the face plate.

In the event an alternative decorative configuration is desired on the surface of the finished cast concrete, the face plate 12 of the concrete wall form 10 can be removed by removing the four bolts and by attaching a substitute face plate 12 to the insulative support section 16 of the concrete wall form 10.

As a further alternative, the face plate 12 could be backed by a layer of insulative material such that the layer of insulative material is positioned between the face plate 12 and the front face of the insulative supporting section 16.

I claim:

1. A removable concrete form for use in casting concrete, the removable concrete form comprising:

a monolithic insulative supporting section having a front face and a rear face and having a pair of parallel spaced apart side walls, spaced apart transverse top and bottom walls, and a plurality of intersecting partition walls forming a lattice in said supporting section;

insulative material located in said lattice;

a planar face plate secured against the front face of said insulative supporting section; and a supporting frame joined to the rear face of said insulative supporting section for providing structural support to said insulative supporting section, said supporting frame including at least a pair of ribs attached to the rear face of said insulating supporting section, said insulative supporting section and said supporting frame forming an integrally joined monolithic structure.

2. The removable concrete form set forth in claim 1 wherein said insulative material is polymer foam.

3. The removable concrete form set forth in claim 1 further including means for removably attaching said face plate to said insulative supporting section.

4. The removable concrete form set forth in claim 1 wherein said ribs mutually intersect and are integrally joined together.

5. The removable concrete form set forth in claim 2 further including means for removably attaching said face plate to said insulative supporting section.

6. The removable concrete form set forth in claim 2 wherein said ribs are integrally joined to said insulative supporting section.

7. The removable concrete form set forth in claim 3 wherein said ribs are integrally joined to said insulative supporting section.

8. The removable concrete form set forth in claim 1 wherein said monolithic insulative supporting section includes a backing plate integrally joined to said rear face of said insulative supporting section and said ribs integrally connected to said backing plate and extending rearwardly from said backing plate.

9. The removable concrete form set forth in claim 8 wherein said ribs include at least a first pair of planar spaced apart ribs generally parallel to said side walls and at least a second pair of planar spaced apart ribs generally parallel to said top and bottom walls, said second pair of ribs intersecting said first pair of ribs.

* * * * *